United States Patent [19]

Johne et al.

[11] Patent Number: 4,539,907

[45] Date of Patent: Sep. 10, 1985

[54] METHOD AND DEVICE FOR POSITIONING PRINTING CYLINDER AND INK-APPLYING ROLLERS IN A PRINTING MACHINE

[76] Inventors: Hans Johne, Geschwister-Scholl-Str. 9, 8122 Radebeul; Arndt Jentzsch, Friedewaldstrasse 3a, 8270 Coswig; Herbert Doliner, Gröbener Str. 3, 8254 Niederau; Werner Frenzel, Weststrasse 40, 8122 Radebeul; Karl-Heinz Förster, Spitzwegstrasse 70, 8020 Dresden; Johannes Naumann, Hermann-Matern-Str. 3a, 8270 Coswig, all of German Democratic Rep.

[21] Appl. No.: 456,754

[22] Filed: Jan. 10, 1983

[30] Foreign Application Priority Data

Jun. 3, 1982 [DD] German Democratic Rep. ... 240408

[51] Int. Cl.[3] ..... B41F 13/12; B41F 9/10

[52] U.S. Cl. ..... 101/248

[58] Field of Search ..... 101/248, 181, 183, 226–228, 101/169, 350, 216–217; 74/675

[56] References Cited

U.S. PATENT DOCUMENTS

| | | | |
|---|---|---|---|
| 3,732,815 | 5/1973 | Greiner et al. | 101/248 X |
| 3,817,176 | 6/1974 | Schultz | 101/248 |
| 3,884,146 | 5/1975 | Ruetschle | 101/183 |
| 4,350,093 | 9/1982 | Ishii | 101/248 X |

*Primary Examiner*—E. H. Eickholt

[57] ABSTRACT

Method and device for positioning application rollers and printing cylinders in the printing machine during the operation with reduced machine numbers of revolutions occuring during the slow-down operation, tipping operation or hand operation, in which a precise transmission of the torque to printing units and thus accurate development of predetermined angular rotation steps is possible due to the fact that a portion of the torque of the whole initial breakaway torque is applied directly to each individual printing unit and the remaining portion of the torque required for positioning of printing cylinders and application rollers is produced by an auxiliary drive.

3 Claims, 4 Drawing Figures

METHOD AND DEVICE FOR POSITIONING PRINTING CYLINDER AND INK-APPLYING ROLLERS IN A PRINTING MACHINE

BACKGROUND OF THE INVENTION

The present invention relates to rotary printing machines in general, and particularly to a method and device for components of the printing machine having a decentralized drive. These components may be printing cylinders or ink-applying rollers.

A decentralized drive for a multiple-color printing machine is disclosed, for example in the patent DD-PS No. 90 799. In this printing machine a drive for each printing unit is provided by an individual hydraulic motor assigned to each individual printing unit. In this structure, an electromotor is cooperated with each hydraulic motor of each printing unit, which electromotor is connected to that hydraulic motor via a control unit. During a slow-speed, or tipping operation the flow stream of the hydraulic motor is reduced to a desired value. During a hand operation required, for example for a fine adjustment of the printing cylinders and color applying rollers, the hydraulic generator or motor must be moved by a hand crank coupled with a transmisson gear unit to produce a desired flow stream. This solution has, however, a disadvantage that when a reduced number of revolutions is required, a constructive conditioned leakage in a transmition of a rotary moment of the hydraulic motor and thus the rotational speed of the printing cylinders and color application rollers are strongly affected. The number of revolutions of the motor fluctuates in dependence upon the occurrence of a rotation-angle-depending motor leakage. Those fluctuations in the number of revolutions of cylinders and rollers make it very difficult to adequately position the printing cylinders and ink-applying rollers.

SUMMARY OF THE INVENTION

It is therefore an object of the invention to avoid the disadvantages of conventional multiple-color printing machines.

It is another object of the invention to provide an improved device for positioning printing cylinders and color applying rollers of the printing machine, which device has a high accuracy and is rather inexpensive.

Still a further object of the invention is to provide a device which at reduced rotational speed of the printing machine, which are required during the slow-speed, or tipping or hand operation, provides for accurate transmission of a rotation moment to the printing unit and thus makes it possible to obtain a precise predetermined rotation angle-step.

These and other objects of the invention are attained by a method for positioning rotary components of a printing machine, particularly printing cylinders and application rollers, in which a main drive of the printing machine is a decentralized drive, which machine has a plurality of printing units each driven by an individual motor connected to the main drive, and wherein positioning of the printing cylinder and application rollers is performed by an auxiliary drive during slow-down operation, or tipping operation or hand operation, the method comprising applying a portion of the initial breakaway torque required for the whole printing machine directly to an individual motor of the assigned printing unit and producing the remaining portion of the torque required for positioning of the printing cylinders and application rollers by the auxiliary drive.

According to a further feature of the invention that portion of the breakaway torque can amount to 60–80% of the initial breakaway torque required for the printing machine.

The device according to the invention includes an auxiliary drive which comprises an auxiliary motor and a hand crank connected to a locking mechanism operative in dependence upon the direction of rotation, a self-lagging gear unit, a coupling engageable with a closed gear train of the printing cylinders and ink-application rollers, and an adjustment unit for controlling that coupling. It is to be noted that an auxiliary motor and a hand crank are assigned for each printing unit. The auxiliary motor and the hand crank are operative in an alternative mode.

The self-lagging gear unit may be a conventional worm unit which has an axle connected to a gear of the a transfer drum of the printing unit.

The auxiliary motor connected to the closed gear train and the drive motors of the printing units may be hydraulic cylinders.

The locking mechanism may include a ratchet wheel mounted to said hand crank and two ratchet pawls each adapted to engage said ratchet wheel depending upon the direction of rotation of said wheel.

The printing machine according to the invention may be provided with a hand pump equipped with a hydraulic storage device.

The advantage of the method and device of the present invention is that even very small predetermined angular steps in positioning of the printing cylinders and ink application rollers may be obtained due to the invention whereby that positioning is possible with any required accuracy.

The torque which can be applied by hand or by the auxiliary motor can, due to adjusting of the torque portion, and directing it immediately to the hydraulic motors for driving the printing units, be minimal whereby rotation of the printing machine components is facilitated. The measurements in the gearing remain small and leakage has no influence on the rotation of the motors.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

The invention will be described with respect to a printing machine having three printing units; it is, of course understood that the device according to the invention can be applied for a printing machine employing any number of printing units.

Figure 1:
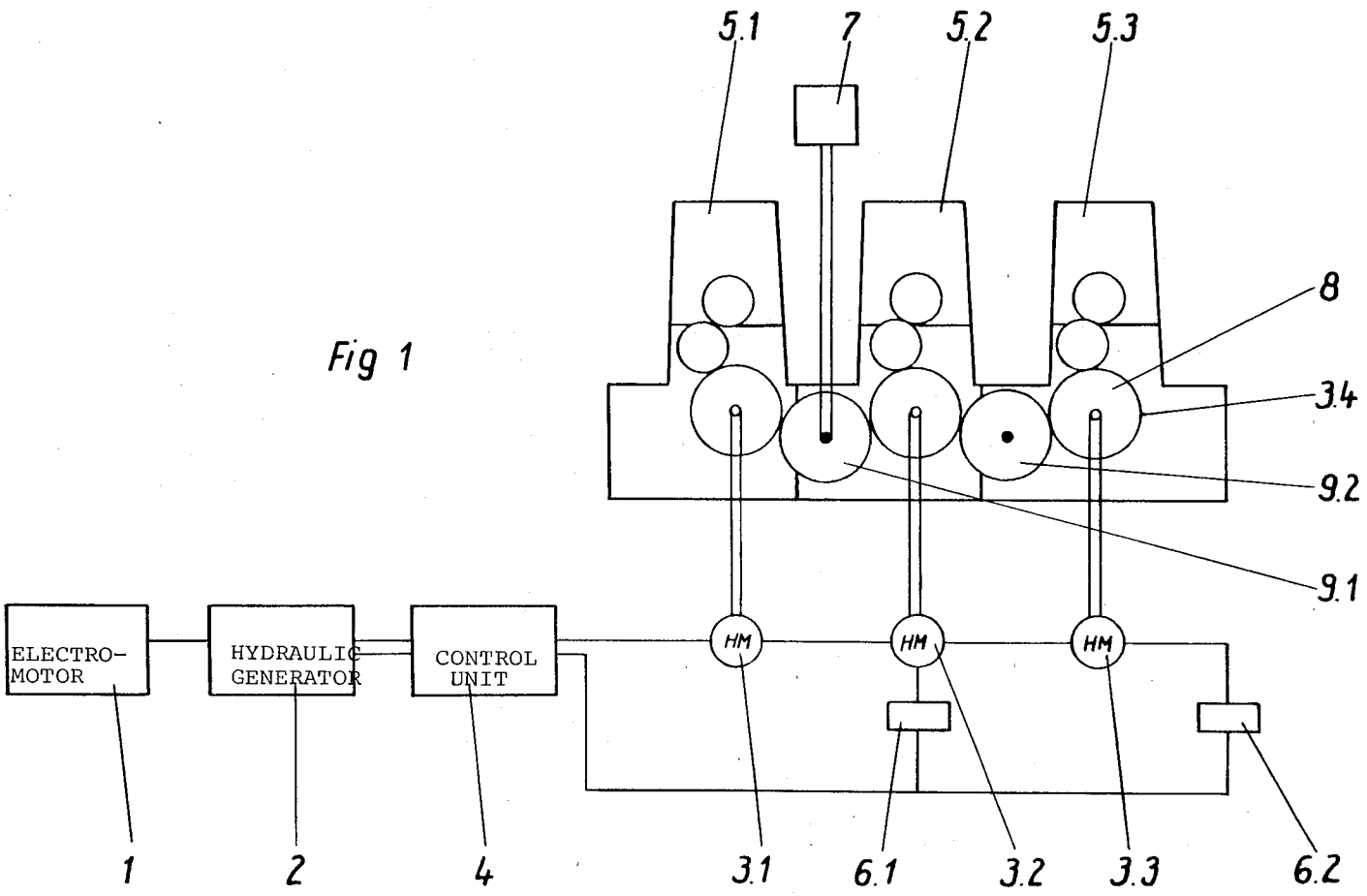
FIG. 1 is a schematic view of a printing drive.

With reference to FIG. 1, it is seen that a main drive of the printing machine includes a hydraulic generator or motor 2 driven by an electromotor 1 and providing a required pressure oil stream for driving hydraulic motors 3.1; 3.2 and 3.3 each driving an individual printing unit 5.1, 5.2 and 5.3, respectively. A control unit 4 is interconnected between the hydraulic generator 2 and hydraulic motors 3.1; 3.2 and 3.3. In order to ensure that differentiated portions of the rotation moment are applied to individual printing units 5.1; 5.2 and 5.3 differential valves 6.1 and 6.2 are arranged between the control unit 4 and second and third, respectively, printing units 5.2 and 5.3.

All printing units 5 are connected to each other by a closed gear train. An auxiliary drive 7 is engaged in this closed gear train for positioning printing cylinders and rollers or realizing a predetermined adjustment and working process, which is required, for example for fine adjustment of the printing cylinders and application rollers. By this auxiliary drive 7 the printing machine can be moved to the operation position for slow-speed, or tipping or hand operation. Therefore, 60–80% of the initial breakaway torque required for the whole machine can be applied to the respective hydraulic motors 3. The auxiliary drive 7 produces the remaining portion of the torque required for moving or positioning the printing cylinders and application rollers. As further seen in FIG. 1 the printing machine includes printing cylinders 8 and color applying rollers in each printing unit 5.1, 5.2 and 5.3 and transfer drums 9.1 and 9.2 interconnected between printing cylinders of individual printing units. The auxiliary drive 7 has a shaft connected to a shaft of the transfer drum 9.1.

Figure 2:
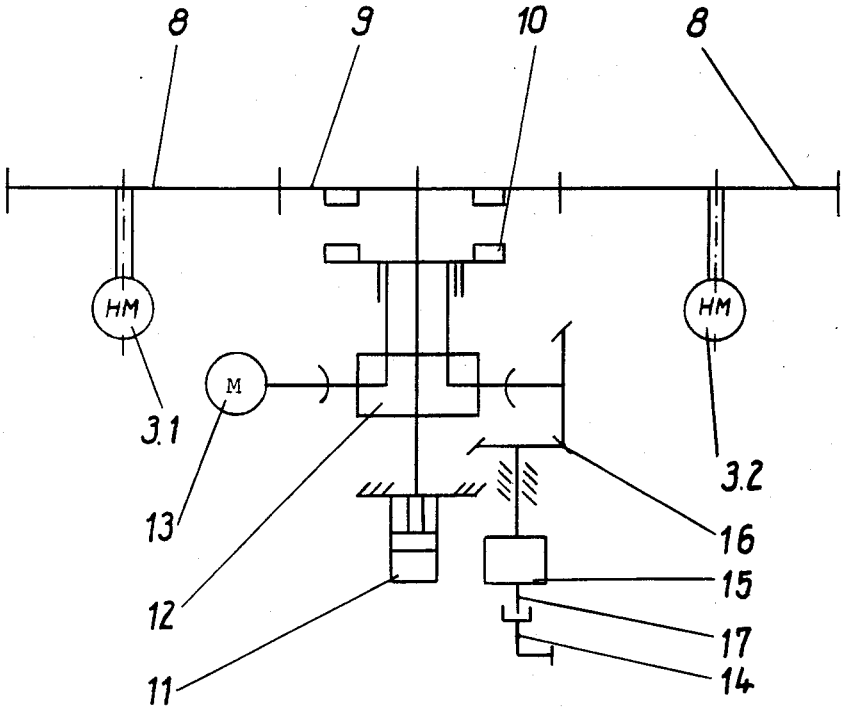
FIG. 2 is a schematic view of the device for positioning printing cylinders and application rollers according to the invention.

FIG. 2 illustrates the structure of the auxiliary drive 7. This drive includes a coupling 10 arranged on the shaft of the transfer drum 9 located between two printing cylinders 8. Coupling 10 is loaded via an adjustment unit 11 which is formed in the preferred embodiment as a coupling hydraulic cylinder operated to place the coupling 10 into its engagement position or disengagement position of the shaft of transfer drum 9. The auxiliary drive 7 further comprises a worm gear unit 12 which selectively couples the coupling 10 with an auxiliary motor 13 or with a hand crank 14. The worm gear unit 12 is so constructed that it operates in an automatically-lagging manner. This insures the fact that uncontrolled load fluctuations in the printing machine will not start up. The hand crank 14 is connected to the worm gear unit 12 through a locking mechanism 15 mounted on the common shaft 17 with the hand crank 14, and a pair of bevel gears 16.

Figure 3:
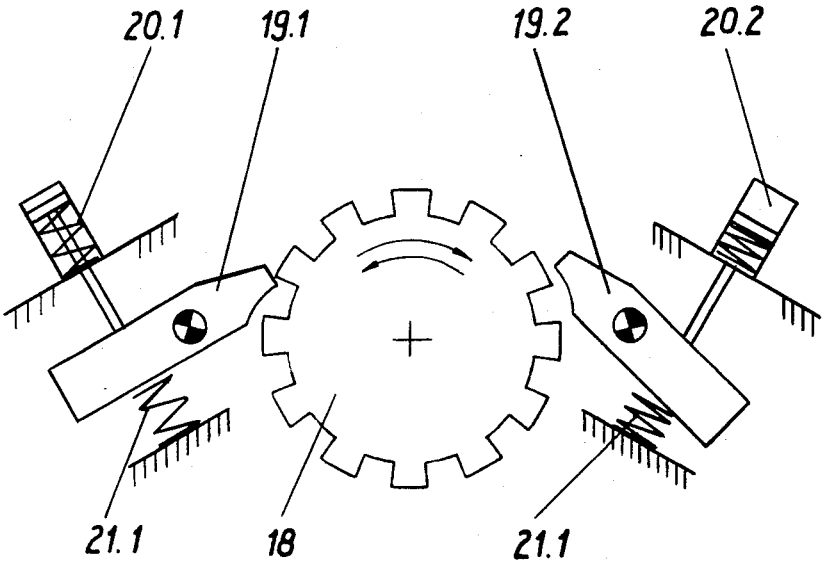
FIG. 3 is a schematic view of a locking mechanism.

FIG. 3 illustrates the locking mechanism 15 in detail. This mechanism includes a ratchet wheel 18 located on the shaft 17 and two ratchet pawls 19.1; 19.2 oppositely positioned with respect to the ratchet wheel 18. The ratchet pawls 19.1 and 19.2 are alternatively engageable with the ratchet wheel 18. Each pawl is biased by a respective compression spring 21.1; 21.2 and operated by a respective hydraulic cylinder 20.1 or 20.2. The locking mechanism 15 ensures that the hand crank 14 can operate in only one preselected direction of rotation defined by hydraulic motors 3.

Figure 4:
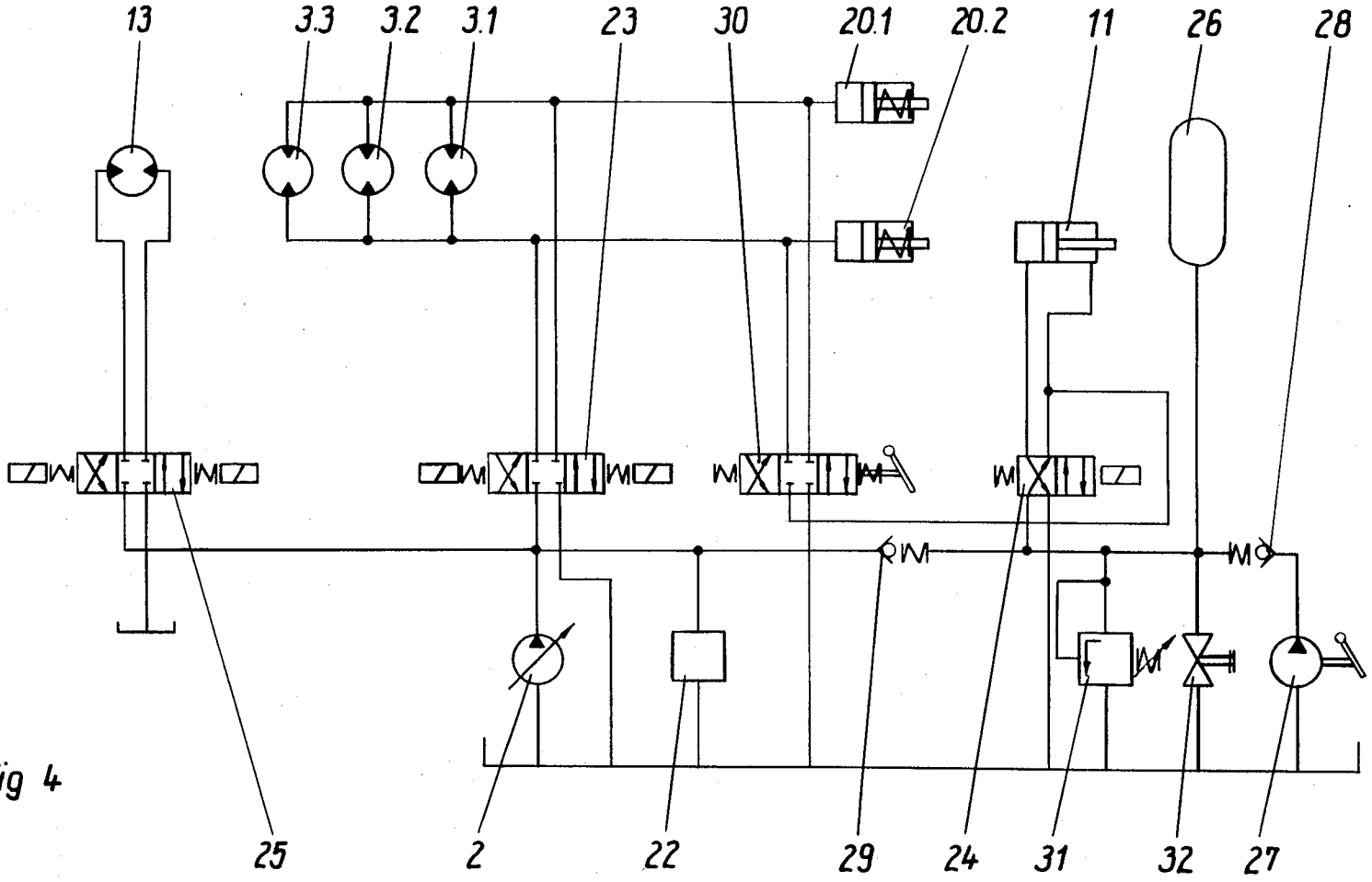
FIG. 4 is a switch diagram of the device according to the invention.

The cooperation of the above described components of the printing machine will be explained with reference to FIG. 4.

The adjustable hydraulic generator 2 produces an oil stream required for various speeds of the main drive including motors 3. The pressure fuse protection is provided herein by a conventional and therefore not-described herein electrical reversible pressure limiting valve 22 arranged in parallel with hydraulic generator 2, which valve is switched over under working conditions with allowable working pressures. The direction of rotation of hydraulic motors 3.1–3.3 connected to the generator 2 is defined by means of a main valve 23.

In the operation mode during the slow-speed, tipping and hand operations, pressure-limiting valve 22 will be switched over to take a portion of 60–80% of load pressure out of the whole initial breakaway torque. This load pressure is lower than the allowable operation pressure. The hydraulic cylinder 11 which is the adjustment unit of the coupling 10, as was mentioned above, is operated through a coupling valve 24. Thereby the auxiliary drive 7 will be coupled with the closed gear train 33 of the printing machine.

The slow-speed auxiliary hydraulic motor 13 is operated by a slow-speed valve 25 connected to the hydraulic generator 2. The number of revolutions of the hydrualic motor 13 is varied by adjusting of the oil flow stream in the hydraulic generator 2.

If an electric net is turned off the hydraulic generator 2 which is driven by the electromotor 1 (FIG. 1) produces no pressure oil flow. In this instance a hydraulic storage device 26 is used for rotation of hydraulic motors 3, which device is filled with oil by means of hand pump 27 via a reverse valve 28.

If the auxiliary drive 7 is uncoupled the pressure oil is applied via the coupling valve 24 to a hand-operated valve 30 and can therefore feed hydraulic motors 3.1–3.3 in both directions of rotation by a hand operation.

Another pressure-limiting valve 31 serves for pressure fuse protection of the hydraulic storage device 26 because the storage device is separated from the first pressure-limiting valve 22 by a reverse valve 29. Pressure is applied to the hydraulic storage device via the reverse valve 29 always in each individual operation mode so that when the electric net is shut off only a portion of the breaking pressure fluid of the machine must be pumped to the storage device.

A shut-off valve 32 serves for emptying of the hydraulic storage device 26.

In the examplified embodiment the invention has been described with the aid of hydraulic components of the printing machine having a decentralized drive. The invention is also applicable to other printing machines having a decentralized main drive.

It will be understood that each of the elements described above, or two or more together, may also find a useful application in other types of methods and devices for positioning printing cylinders and ink application rollers differing from the types described above.

While the invention has been illustrated and described as embodied in a method and device for positioning movable components of the printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for positioning rotary components of a printing machine, particularly printing cylinders and application rollers, which machine has a main drive which is a decentralized drive and a plurality of printing units each driven by an individual drive motor connected to the main drive, and wherein positioning of the printing cylinders and application rollers is performed by an auxiliary drive during slow-down operation, or tipping operation or hand operation, the method comprising applying a portion of the initial breakaway torque required for the whole printing machine directly to individual motors of the assigned printing units, and producing the remaining portion of the torque, required for positioning of the printing cylinders and application rollers, by the auxiliary drive.

2. The method as defined in claim 1, wherein said portion of the torque amounts to 60–80% of the initial breakaway torque required for the printing machine.

3. The method as defined in claim 1, wherein the direction of said torque is preselected.

* * * * *